US009364393B1

(12) United States Patent
Grabowski et al.

(10) Patent No.: US 9,364,393 B1
(45) Date of Patent: Jun. 14, 2016

(54) PACKAGING SYSTEM FOR LIQUID MEDICATIONS

(75) Inventors: William J. Grabowski, Randolph, MA (US); Peter J. DeCoste, Jr., Holbrook, MA (US)

(73) Assignee: HealthStar, Inc., Braintree, MA (US)

( * ) Notice: Subject to any disclaimer, the term of this patent is extended or adjusted under 35 U.S.C. 154(b) by 399 days.

(21) Appl. No.: 13/587,971

(22) Filed: Aug. 17, 2012

(51) Int. Cl.

| | |
|---|---|
| ***B65D 47/10*** | (2006.01) |
| ***A61J 1/06*** | (2006.01) |
| ***A61J 7/00*** | (2006.01) |
| *B65D 1/09* | (2006.01) |

(52) U.S. Cl.
CPC ..... *A61J 1/067* (2013.01); *A61J 7/0053* (2013.01); *A61J 7/0023* (2013.01); *B65D 1/095* (2013.01)

(58) Field of Classification Search
CPC ..... A61J 1/067; A61J 7/0023; A61J 7/0053; B65D 1/095
USPC ..... 206/528–539, 443, 445, 820; 215/48, 215/49, DIG. 3; 222/94, 95, 97, 104, 107, 222/129, 215, 541.6, 541.9, 210; 604/200, 604/240, 241, 244, 212; D24/115
See application file for complete search history.

(56) References Cited

U.S. PATENT DOCUMENTS

| | | | | |
|---|---|---|---|---|
| 3,917,120 | A * | 11/1975 | Larenz et al. | 222/541.9 |
| 3,993,223 | A * | 11/1976 | Welker et al. | 222/107 |
| 4,078,566 | A | 3/1978 | Urban, Jr. | |
| 4,512,475 | A * | 4/1985 | Federighi | 206/820 |
| D309,097 | S | 7/1990 | Price | |
| 5,009,309 | A * | 4/1991 | Hansen | 206/820 |
| D330,160 | S | 10/1992 | Umekawa | |
| 5,409,125 | A | 4/1995 | Kimber et al. | |
| D362,390 | S | 9/1995 | Weiler | |
| 5,587,177 | A | 12/1996 | Grimberg | |
| D379,663 | S | 6/1997 | Pearson et al. | |
| 6,173,852 | B1 | 1/2001 | Browne | |
| 6,234,333 | B1 * | 5/2001 | Federighi et al. | 215/48 |
| 6,241,124 | B1 * | 6/2001 | Hoyt | 222/143 |
| 6,276,533 | B1 | 8/2001 | Kaplan | |
| D492,028 | S | 6/2004 | Masuda et al. | |
| D492,406 | S | 6/2004 | Masuda et al. | |
| 6,860,405 | B1 * | 3/2005 | Poynter | 222/541.6 |
| D515,936 | S | 2/2006 | Ko | |
| D517,207 | S | 3/2006 | Poynter | |

(Continued)

OTHER PUBLICATIONS

Romelag Product No. 2048 Ampule, Jun. 6, 1990, (1 page).

(Continued)

*Primary Examiner* — Luan K Bui
(74) *Attorney, Agent, or Firm* — Altman & Martin; Steven K. Martin

(57) ABSTRACT

A dosing system for analgesic liquid suspensions including unit dose containers made using blow-fill-seal (BFS) technology. The containers come in various sizes and hold appropriate doses for specific weight ranges. Each container has body with a compartment for holding the liquid, finger rests for squeezing the container to expel the liquid, a tab at one end for labeling, and a twist-off closure at the other end. In the larger containers, the opening end has a lip rest, which is a flattened section that includes opposed, curved depressions. In the smallest container, the opening end has a long tapered neck. The suspension has a relatively low viscosity to ensure more complete dose evacuation from the container. The containers will be sold in assemblages of various combinations of sizes.

14 Claims, 3 Drawing Sheets

(56) References Cited

U.S. PATENT DOCUMENTS

| | | | | |
|---|---|---|---|---|
| 7,032,590 | B2 * | 4/2006 | Loeffler et al. | 206/528 |
| D539,903 | S | 4/2007 | Strong | |
| D544,644 | S | 6/2007 | Hartstock et al. | |
| D544,958 | S | 6/2007 | Wurtz et al. | |
| D565,193 | S | 3/2008 | Price | |
| D571,002 | S | 6/2008 | Starnes | |
| 7,487,894 | B2 * | 2/2009 | Zahn et al. | 222/541.9 |
| 7,607,541 | B2 | 10/2009 | Girgis et al. | |
| D641,642 | S | 7/2011 | Caldwell et al. | |
| D666,289 | S * | 8/2012 | DeCoste | D24/115 |
| 2004/0024372 | A1 | 2/2004 | Grogan | |
| 2004/0094449 | A1 * | 5/2004 | Schmid | 206/528 |
| 2005/0202085 | A1 | 9/2005 | Lovercheck | |
| 2008/0000798 | A1 * | 1/2008 | Gutmann et al. | 206/532 |
| 2008/0083691 | A1 | 4/2008 | Poynter et al. | |
| 2009/0101650 | A1 * | 4/2009 | Hansen | B65D 1/095 D1/95 |
| 2010/0163577 | A1 * | 7/2010 | Hansen | 222/541.9 |

OTHER PUBLICATIONS

Romelag Drawing No. 3682A-A25B60, Jun. 13, 2007, (1 page).
Romelag Drawing No. 3682A-A09B60, Jun. 13, 2007, (1 page).

* cited by examiner

| Weight (lbs) | Concentrated Drops 80 mg/0.8 ml Dropperful (0.8 ml) | Suspension Liquid 160 mg/5.0 ml Teaspoon (5 ml) |
|---|---|---|
| 6-11 | ½ = 0.4 ml = 40 mg | |
| 12-17 | 1 = 0.8 ml = 80 mg | ½ = 2.5 ml = 80 mg |
| 18-23 | 1½ = 1.2 ml = 120 mg | ¾ = 3.725 ml = 120 mg |
| 24-35 | 2 = 1.6 ml = 160 mg | 1 = 5.0 ml = 160 mg |
| 36-47 | | 1½ = 7.5 ml = 240 mg |
| 48-59 | | 2 = 10 ml = 320 mg |
| 60-71 | | 2½ = 12.5 ml = 400 mg |
| 72-95 | | 3 = 15 ml = 480 mg |
FIG. 1
Prior Art
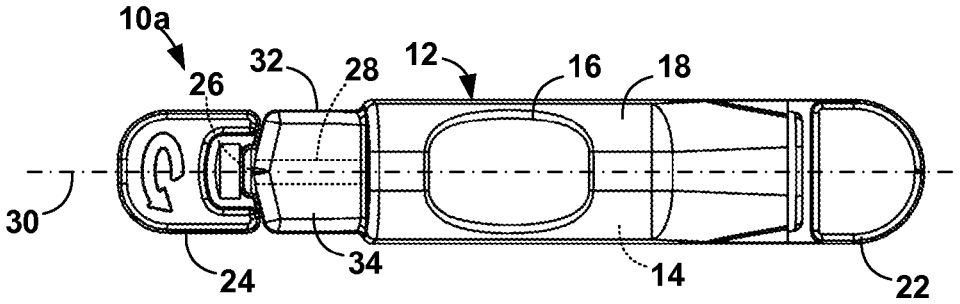
FIG. 2a
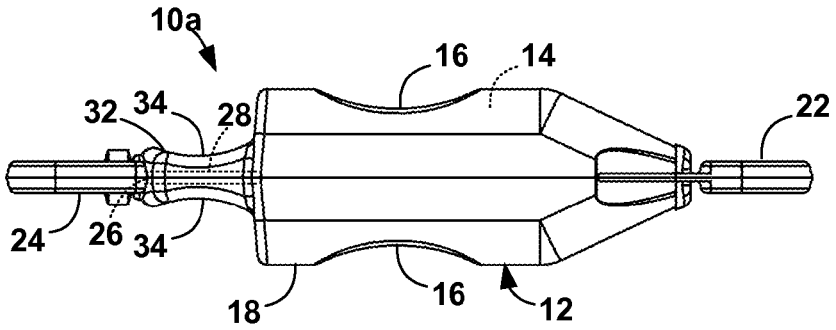
FIG. 2b

PACKAGING SYSTEM FOR LIQUID MEDICATIONS

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to pharmaceutical packaging, more particularly, to single dose packaging for children's medications.

2. Description of the Related Art

Acetaminophen is an analgesic that is safe and effective for children when taken in recommended dosages. However, it can cause liver damage and other health issues if taken in too great a quantity, either at one time or over time. The appropriate dose of acetaminophen for a child is typically determined by the child's weight, generally in milliliters per range of weight. An example of such dosing is the dosing chart for Children's TYLENOL acetaminophen, shown in FIG. 1.

Liquid acetaminophen for children is available in multiple dose bottles. For administering to a child, the appropriate dose is poured into a small, graduated cup, from which the child drinks, or is drawn into an oral syringe that is expelled into the child's mouth. With both methods, it is difficult to get the exact amount into the child. The graduations on the cup are close together and difficult to read. The liquid in a syringe can have bubbles and the liquid in the neck at the orifice is typically not expelled.

Overdosing a child can happen in a number of different ways. If the caregiver is in a hurry, he/she may not measure as accurately as necessary. The caregiver may inadvertently use an adult formulation rather than a child formulation. If the bottle is left open, the child may mistakenly believe that the acetaminophen as something that is safe to drink.

Multiple dose bottles can also have issues with contamination. Inserting a used syringe into the bottle can contaminate the liquid if it is not cleaned properly. Touching the inside of the bottle or the cap can cause contamination. Leaving the bottle open for a period of time can cause the liquid to become contaminated. Contaminated medicine in a multi-dose bottle can spread diseases.

BRIEF SUMMARY OF THE INVENTION

The present invention is a dosing system for analgesic liquid suspensions where unit dose containers are made for specific weight ranges of children in order to prevent overdosing and contamination, and for ease in administering to the child.

The containers are made using blow-fill-seal (BFS) technology. In one configuration, there are four different sizes for the unit dose container: a 15 ml container, a 7.5/10 ml container, a 3.75/5 ml container, and a 1.25/2.5 ml container. Each container holds an appropriate dose for a particular weight range.

Each container has body with a compartment for holding the liquid, opposed finger rests for squeezing the container to expel the liquid, a tab at one end of the body for labeling, and a twist-off closure at the other end of the body that covers the opening of a passage through which the liquid is expelled.

In the larger containers, the end of the body with the opening has a lip rest, which is a flattened section that includes opposed, curved depressions. The smallest container has a long tapered neck through which the passage extends.

The analgesic suspension has a relatively low viscosity that flows more easily than the suspensions of the prior art. This ensures more complete dose evacuation from the container, thereby ensuring more accurate dosing.

The present invention contemplates that the containers will be sold in assemblages of various combinations of sizes. In one combination, there is one container of each size. In another combination, there are different numbers of containers of each size. In another combination, all the containers are the same size.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein:

FIG. 1 is a prior art dosing chart for Children's TYLENOL acetaminophen;

FIG. 2 is two views of a 15 ml container of the present invention;

DETAILED DESCRIPTION OF THE INVENTION

Figure 3A:
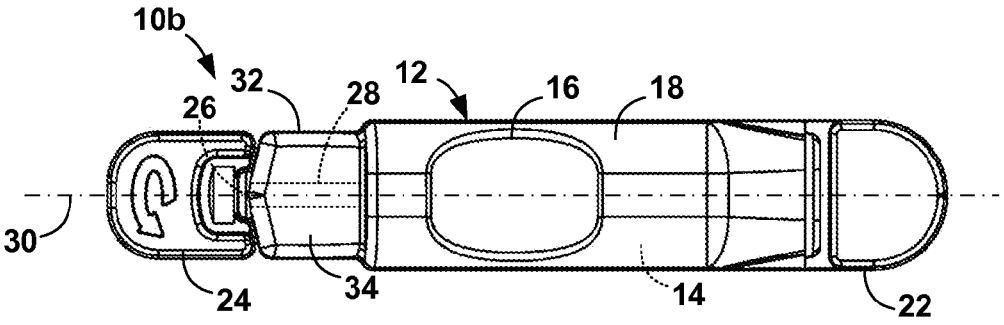
FIG. 3 is two views of a 10 ml container of the present invention.

The present invention is a dosing system for analgesic liquid suspensions where unit dose containers are made for specific weight ranges of children in order to prevent overdosing and contamination, and for ease in administering to the child.

Preferably, the containers are made using blow-fill-seal (BFS) technology. Pharmaceutical-grade plastic resin, such as low-density polyethylene, is heat extruded through a circular throat to form a hanging tube. The tube is enclosed by a two-part mold and inflated to form a container within the mold. The container is filled with the analgesic suspension and a secondary mold seals the container. The process takes place inside a class 100 shroud inside the BFS machine. The sealed container is discharged for labeling, packaging. and distribution. Optionally, the containers are overwrapped with a foil/poly film to provide better stability and flavor retention during transportation and storage.

In one configuration of present invention, there are four different sizes for the unit dose container: a 15 ml container 10*a*, a 7.5/10 ml container 10*b*, a 3.75/5 ml container 10*c*, and a 1.25/2.5 ml container 10*d* (collectively, 10), shown in FIGS.

2-6. Each container 10 holds an amount of analgesic suspension that provides an appropriate dose of analgesic for a particular weight range. The dosages are based a suspension with an analgesic concentration of 160 milligrams per 5 milliliters (160 mg/5 ml=32 mg/ml). Thus, the 1.25/2.5 ml container 10*d* holds either 40 mg (1.25 ml) or 80 mg (2.5 ml) of analgesic, the 3.75/5 ml container 10*c* holds either 120 mg (3.75 ml) or 160 mg (5 ml) of analgesic, the 7.5/10 ml container 10*b* holds either 240 mg (7.5 ml) or 320 mg (10 ml) of analgesic, and the 15 ml container 10*a* holds 400 mg of analgesic.

The containers 10 and doses described above work well for an acetaminophen suspension. The present invention, however, contemplates that the present invention can be used with other analgesics, and thus with different size containers 10, different analgesic concentrations, and different doses. A person of skill in the art will know how to adjust the container sizes, concentrations, and/or doses as needed for different analgesics.

The different size containers 10 have several common elements. Each container 10 has body 12 with a compartment 14 for holding the liquid. The size of the compartment 14, of course, depends on how much liquid the particular container 10 is to hold. In the current configuration, the 15 ml container 10*a* has a total volume of 17 ml±0.5 ml, the 7.5/10 ml container 10*b* has a total volume of 12 ml±0.5 ml, the 3.75/5 ml container 10*c* has a total volume of 7 ml±0.5 ml, and the 1.25/2.5 ml container 10*d* has a total volume of 5 ml±0.5 ml.

Each container 10 has opposed finger rests 16 for squeezing the container 10 to expel the liquid. The finger rests 16 are rounded indentations in the sides 18 of the body 12 outside of the compartment 14. Optionally, the finger rests 16 are textured to provide a non-slip grip. The texturing can include a plurality of ridges 20.

Each container 10 has a tab 22 at one end of the body 12. The tab 22 can be use for labeling or other functions. Typically, the lot number and expiration date will be on the tab 22. Other identifying information, such as a trademark, may also be on the tab 22.

Each container 10 has a twist-off closure 24 at the other end of the body 12. The closure 24 covers an opening 26 of a passage 28 through which the liquid is expelled from the compartment 14 during administration. The closure 24 is removed by twisting it around the longitudinal axis 30 of the container 10 until it snaps off, thereby exposing the opening 26. The opening 26 will be in the range from about 0.08 inch to about 0.15 inch.

Figure 3B:
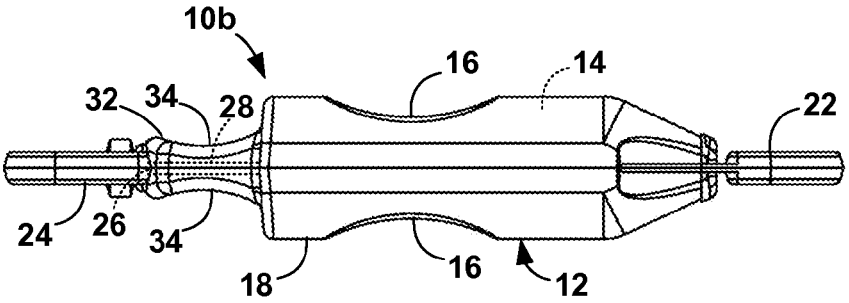
Figure 4A:
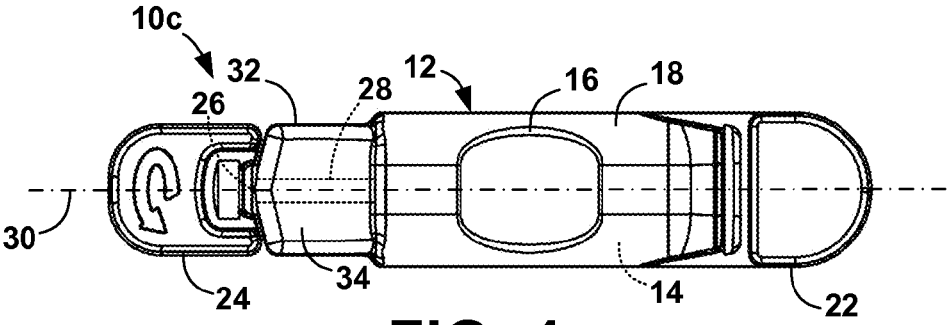
FIG. 4 is two views of a 5 ml container of the present invention.
Figure 4B:
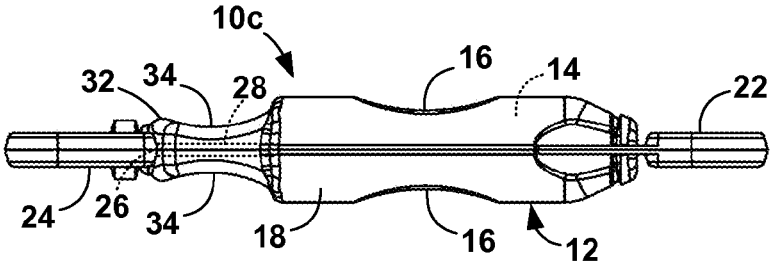

In the larger containers 10*a*, 10*b*, 10*c* of FIGS. 2-4, the end of the body 12 with the opening 26 has a lip rest 32 through which the passage 28 extends. The lip rest 32 is a flattened section that includes opposed, curved depressions 34. The lip rest 32 facilitates a seal between the user's lips and the container 10, thereby reducing the chance of spillage during administration.

Figure 5A:
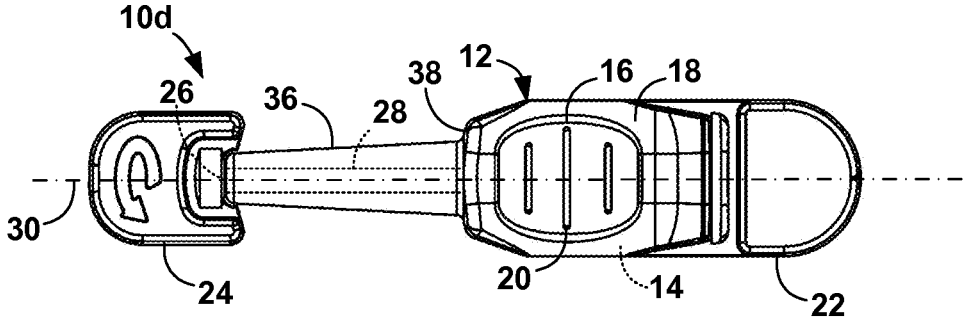
FIG. 5 is two views of one configuration of a 1.25/2.5 ml container of the present invention.
Figure 5B:
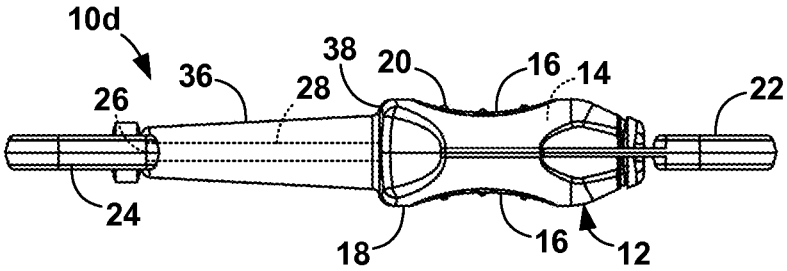
Figure 6A:
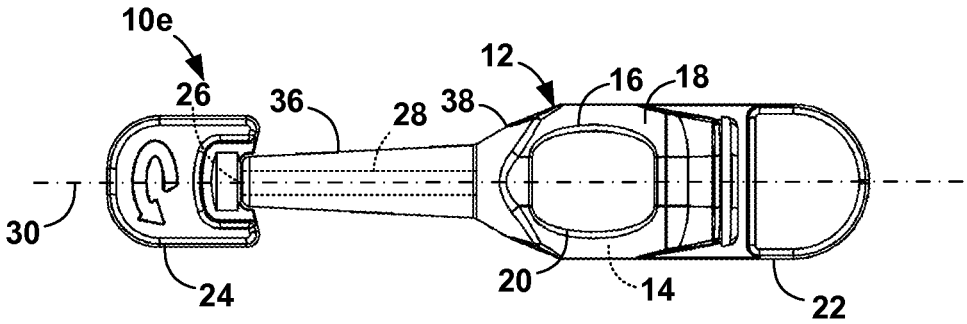
FIG. 6 is two views of another configuration of a 1.25/2.5 ml container of the present invention.
Figure 6B:
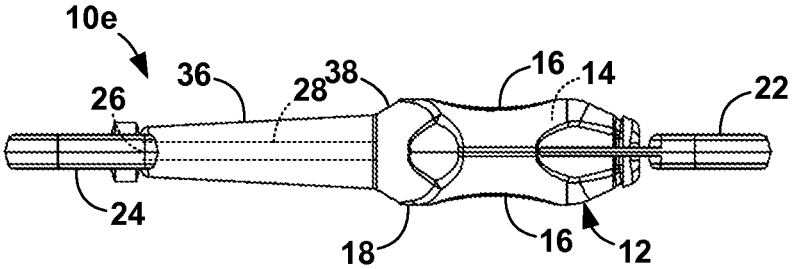

The 1.25/2.5 ml container 10*d*, 10*e* of FIGS. 5 and 6 is intended for use with infants and young children, who generally are not able to manipulate the larger containers 10*a*, 10*b*, 10*c*. To that end, the 1.25/2.5 ml container 10*d*, 10*e*, rather than having a lip rest 32, has a long tapered neck 36 through which the passage 28 extends. In the current configuration, the neck 36 is approximately 1.06 inches long. The neck 36 is designed to be placed in the child's cheek or under the tongue for administration. The difference between the container 10*d* of FIG. 5 and the container 10*e* of FIG. 6 is in the shape of the end 38 of the body 12 from which the neck 36 extends. In the configuration of FIG. 5, the body end 38 is blunt, that is, the neck 36 extends from a relatively flat surface. In the configuration of FIG. 6, the body end 38 is tapered toward the neck 36.

The relatively high-viscosity ("thick") analgesic suspension, on the order of 716 centipoises (cP), used in the prior art tends to adhere thickly to the sides of the dosing cup so that not all of the medication is administered to the child. The present invention uses a relatively low-viscosity ("thin") analgesic suspension. The thin suspension flows more easily and adheres thinly to the sides of the container. This ensures more complete dose evacuation from the container, thereby ensuring more accurate dosing. The present invention contemplates a viscosity in the range of 300 to 1500 cP with a preferred range of 650 to 700 cP and a preferred value of 681 cP.

The present invention contemplates that the containers 10 will be sold in assemblages of various combinations of sizes. In one combination, the assemblage includes one container of each size. In another combination, the assemblage includes different numbers of containers of each size. In another combination, the assemblage includes a plurality of containers of the same size.

Thus it has been shown and described a packaging system for liquid medications.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A packaging system comprising a plurality of different sizes of unit dose containers, each of the unit dose containers holding an amount of an analgesic suspension between 1.25 milliliters to 15 milliliters, said analgesic suspension having a viscosity of between 300 centipoises and 1500 centipoises, each of said containers comprising:

(a) a body;

(b) a compartment within the body;

(c) opposed finger rests on either side of the body outside of the compartment adapted for squeezing the compartment;

(d) a tab at one end of the body;

(e) a lip rest at the other end of the body, the lip rest being a flattened section with opposed, inwardly curved depressions that extend laterally completely across the lip rest and a passage connecting the compartment to an opening, the lip rest being thinner at the longitudinal center of the depressions than at the longitudinal edges of the depressions;

(f) a twist-off closure covering the opening.

2. The packaging system of claim 1 wherein said finger rests are textured.

3. The packaging system of claim 1 further comprising an assemblage of one of each size of said containers.

4. The packaging system of claim 1 further comprising a plurality of assemblages, each of said plurality of assemblages containing only one of said sizes of said containers.

5. The packaging system of claim 1 wherein said viscosity is in the range of from 650 centipoises to 700 centipoises.

6. The packaging system of claim 1 wherein said plurality of containers includes a 2.5 ml container, a 5 ml container, a 10 ml container, and a 15 ml container.

7. The packaging system of claim 6 wherein said analgesic suspension has a concentration of analgesic of 32 mg/ml and said 2.5 ml container holds either 40 mg or 80 mg of analgesic, said 5 ml container holds either 120 mg or 160 mg of analgesic, said 10 ml container holds either 240 mg or 320 mg of analgesic, and said 15 ml container holds 400 mg of analgesic.

8. A packaging system comprising a plurality of different sizes of unit dose containers, each of the unit dose containers holding an amount of an analgesic suspension between 1.25 milliliters to 15 milliliters, said sizes including a 2.5 ml container, a 5 ml container, a 10 ml container, and a 15 ml container, said analgesic suspension having a viscosity of between 650 centipoises to 700 centipoises, each of said containers comprising:

(a) a body;

(b) a compartment within said body for holding said analgesic suspension;

(c) opposed finger rests on either side of said body outside of said compartment adapted for squeezing said compartment;

(d) a tab at one end of said body;

(e) a lip rest at the other end of the body, the lip rest being a flattened section with opposed, inwardly curved depressions that extend laterally completely across the lip rest and a passage connecting the compartment to an opening, the lip rest being thinner at the longitudinal center of the depressions than at the longitudinal edges of the depressions;

(f) a twist-off closure covering the opening.

9. The packaging system of claim 8 wherein said finger rests are textured.

10. The packaging system of claim 8 further comprising an assemblage of one of each size of said containers.

11. The packaging system of claim 8 further comprising a plurality of assemblages, each of said plurality of assemblages containing only one of said sizes of said containers.

12. The packaging system of claim 8 wherein said analgesic suspension has a concentration of analgesic of 32 mg/ml and said 2.5 ml container holds either 40 mg or 80 mg of analgesic, said 5 ml container holds either 120 mg or 160 mg of analgesic, said 10 ml container holds either 240 mg or 320 mg of analgesic, and said 15 ml container holds 400 mg of analgesic.

13. A unit dose container comprising:

(a) a body;

(b) a compartment within the body;

(c) opposed finger rests on either side of the body outside of the compartment adapted for squeezing the compartment;

(d) a tab at one end of the body;

(e) a lip rest at the other end of the body, the lip rest being a flattened section with opposed, inwardly curved depressions that extend laterally completely across the lip rest and a passage connecting the compartment to an opening, the lip rest being thinner at the longitudinal center of the depressions than at the longitudinal edges of the depressions;

(f) a twist-off closure covering the opening.

14. The packaging system of claim 13 wherein the finger rests are textured.

* * * * *